US008760386B2

(12) United States Patent
An et al.

(10) Patent No.: US 8,760,386 B2
(45) Date of Patent: Jun. 24, 2014

(54) DISPLAY DEVICE AND METHOD FOR DRIVING THE SAME

(75) Inventors: Chung-Hwan An, Seoul (KR); Jae-Woo Lee, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 301 days.

(21) Appl. No.: 13/198,323

(22) Filed: Aug. 4, 2011

(65) Prior Publication Data

US 2012/0032998 A1 Feb. 9, 2012

(30) Foreign Application Priority Data

Aug. 5, 2010 (KR) ..... 10-2010-0075533

(51) Int. Cl.
*G09G 3/36* (2006.01)

(52) U.S. Cl.
USPC ..... 345/102; 345/87; 345/690; 345/89

(58) Field of Classification Search
USPC ..... 345/89, 690, 102, 87
See application file for complete search history.

(56) References Cited

U.S. PATENT DOCUMENTS

| | | | | |
|---|---|---|---|---|
| 7,268,753 | B2 * | 9/2007 | Lee et al. | 345/77 |
| 7,375,719 | B2 * | 5/2008 | Oh et al. | 345/102 |
| 7,443,377 | B2 * | 10/2008 | Kim | 345/102 |
| 7,450,104 | B2 * | 11/2008 | Baik | 345/102 |
| 7,466,301 | B2 * | 12/2008 | Sohn et al. | 345/102 |
| 7,522,135 | B2 * | 4/2009 | Baik | 345/88 |
| 7,609,244 | B2 * | 10/2009 | Kim et al. | 345/89 |
| 7,688,294 | B2 * | 3/2010 | Baik | 345/88 |
| 7,847,782 | B2 * | 12/2010 | Sohn et al. | 345/102 |
| 8,035,661 | B2 * | 10/2011 | Lee et al. | 345/690 |
| 8,134,549 | B2 * | 3/2012 | Han et al. | 345/211 |
| 8,165,419 | B2 * | 4/2012 | Min et al. | 382/274 |
| 8,212,751 | B2 * | 7/2012 | Hwang | 345/87 |
| 8,223,166 | B2 * | 7/2012 | Brown Elliott | 345/596 |
| 8,289,258 | B2 * | 10/2012 | Song et al. | 345/99 |
| 8,305,370 | B2 * | 11/2012 | Song et al. | 345/207 |
| 8,325,128 | B2 * | 12/2012 | Katayama et al. | 345/101 |
| 8,520,032 | B2 * | 8/2013 | Ahn | 345/690 |
| 2002/0021292 | A1 * | 2/2002 | Sakashita | 345/204 |
| 2003/0122845 | A1 * | 7/2003 | Lee et al. | 345/589 |
| 2004/0196252 | A1 * | 10/2004 | Kim | 345/102 |
| 2004/0257329 | A1 * | 12/2004 | Park et al. | 345/102 |
| 2005/0104827 | A1 * | 5/2005 | Baik | 345/87 |

(Continued)

FOREIGN PATENT DOCUMENTS

| | | | |
|---|---|---|---|
| CN | 1619627 | A | 5/2005 |
| CN | 101465096 | A | 6/2009 |

*Primary Examiner* — Alexander S Beck
*Assistant Examiner* — Sejoon Ahn
(74) *Attorney, Agent, or Firm* — Birch, Stewart, Kolasch & Birch, LLP

(57) ABSTRACT

The present invention relates a display device and a method for driving the same which can improve a picture quality. The display device can include a histogram generation/analysis unit for analyzing image data, generating a histogram of the image data to each of the frames, and analyzing the histograms, a gamma reference voltage generating unit for generating gamma reference voltages and adjusting magnitude of the gamma reference voltages according to a result of analysis and forwarding the gamma reference voltages adjusted, a timing controller for re-arranging the image data, controlling output timings of the image data re-arranged and forwarding the image data re-arranged, and a data driver for generating gamma gradient voltages by using the gamma reference voltages, converting the image data into analog image signals by using the gamma gradient voltages and supplying the analog image signals to a display panel.

9 Claims, 8 Drawing Sheets

(56) References Cited

U.S. PATENT DOCUMENTS

| | | | | |
|---|---|---|---|---|
| 2005/0104837 | A1* | 5/2005 | Baik et al. | 345/99 |
| 2005/0104839 | A1* | 5/2005 | Baik | 345/102 |
| 2005/0104841 | A1* | 5/2005 | Sohn et al. | 345/102 |
| 2005/0104842 | A1* | 5/2005 | Baik | 345/102 |
| 2005/0162361 | A1* | 7/2005 | Chuang et al. | 345/89 |
| 2005/0219179 | A1* | 10/2005 | Kim | 345/89 |
| 2006/0114205 | A1 | 6/2006 | Shen et al. | |
| 2008/0111775 | A1* | 5/2008 | Han et al. | 345/77 |
| 2008/0278430 | A1 | 11/2008 | Kim et al. | |
| 2009/0079688 | A1* | 3/2009 | Chen et al. | 345/102 |
| 2009/0115907 | A1* | 5/2009 | Baba et al. | 348/672 |
| 2009/0160880 | A1* | 6/2009 | Park et al. | 345/690 |
| 2009/0184984 | A1* | 7/2009 | Takahara | 345/690 |
| 2010/0165010 | A1* | 7/2010 | Baik et al. | 345/690 |
| 2011/0181599 | A1* | 7/2011 | Cho et al. | 345/440 |
| 2011/0285759 | A1* | 11/2011 | Sakai | 345/690 |
| 2012/0320019 | A1* | 12/2012 | Jeong et al. | 345/211 |

* cited by examiner

DISPLAY DEVICE AND METHOD FOR DRIVING THE SAME

CROSS REFERENCE TO RELATED APPLICATION

This application claims the priority benefit of the Korean Patent Application No. 10-2010-0075533, filed on Aug. 5, 2010 in Republic of Korea, which is hereby incorporated by reference as if fully set forth herein.

BACKGROUND OF THE DISCLOSURE

1. Field of the Disclosure

The present invention relates to display devices, and more particularly to a display device and a method for driving the same which can improve a picture quality.

2. Discussion of the Related Art

A related art display device displays an image according to a gamma gradient curve having a fixed value always regardless of characteristics of the image. Therefore, the related art display device has a limitation in expressing a dynamic image or an image of an emphasized contrast.

SUMMARY OF THE DISCLOSURE

Accordingly, the present invention is directed to a display device and a method for driving the same.

An object of the present invention is to provide a display device and a method for driving the same, in which a histogram of image data on one frame is analyzed, and a gamma reference voltage is adjusted according to a result of the analysis for generating a gamma gradient curve proper to image characteristics.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a display device including a histogram generation/analysis unit for analyzing image data supplied thereto from an outside frame by frame, generating a histogram of the image data included in each of the frames, and analyzing the histograms, a gamma reference voltage generating unit for generating a plurality of gamma reference voltages and adjusting magnitude of the gamma reference voltages according to a result of analysis from the histogram generation/analysis unit and forwarding the gamma reference voltages adjusted thus, a timing controller for re-arranging the image data supplied thereto from an outside, controlling output timings of the image data re-arranged thus and forwarding the image data re-arranged thus, and a data driver for generating a plurality of gamma gradient voltages by using the plurality of gamma reference voltages from the gamma reference voltage generating unit, converting the image data from the timing controller into analog image signals by using the gamma gradient voltages and supplying the analog image signals to a display panel.

The histogram generation/analysis unit includes a brightness extraction unit for extracting brightness components of the image data of one frame, a histogram generating unit for classifying the brightness components of the image data of one frame from the brightness extraction unit by gradients and calculating a frequency of each of the gradients to generate a histogram thereof, and a histogram analyzing unit for analyzing the histogram from the histogram generating unit to determine an average gradient of all gradients in one frame, a number of peak regions including gradients which exceed a preset frequency, an average peak gradient of each of the peak gradients formed at each of the peak regions, and a degree of distribution representing a width of each of the peak regions.

The gamma reference voltage generating unit selects a gamma reference voltage of the average peak gradient of each of the peak regions with reference to the average peak gradient and the degree of distribution from the histogram analyzing unit and adjusts magnitude of the gamma reference voltages adjacent to the gamma reference voltage selected thus according to the degree of distribution.

The gamma reference voltage generating unit adjusts magnitude of the gamma reference voltages such that voltage differences among the gamma reference voltages of the peak regions become the smaller, as the degrees of distribution become the greater; wherein the gamma reference voltage generating unit adjusts the magnitude of each of the gamma reference voltages such that voltage differences among the gamma reference voltages of the peak region become the greater, as the degrees of distribution become the smaller.

The gamma reference voltage generating unit adjusts the magnitude of the gamma reference voltages except a greatest gamma reference voltage having a greatest magnitude and a smallest gamma reference voltage having a smallest magnitude.

The display device further includes a backlight for providing a light to the display panel, and a backlight driving unit for generating a brightness control signal for driving the backlight, wherein the backlight driving unit adjusts a duty ratio of the brightness control signal with reference to the average gradient, the number of peak regions, the average peak gradients, and the degree of distribution.

The backlight driving unit adjusts the duty ratio of the brightness control signal with reference to a greatest average peak gradient.

In another aspect of the present invention, a method for driving a display device includes an A step for analyzing image data supplied from an outside frame by frame, generating a histogram of the image data included in each of the frames, and analyzing the histograms, a B step for generating a plurality of gamma reference voltages and adjusting magnitude of the gamma reference voltages according to a result in the A step, a C step for re-arranging the image data supplied thereto from an outside, controlling output timings of the image data re-arranged thus and forwarding the image data re-arranged thus, and a D step for generating a plurality of gamma gradient voltages by using the plurality of gamma reference voltages, converting the image data from the C step into analog image signals by using the gamma gradient voltages and supplying the analog image signals to a display panel.

The A step includes an E step for extracting brightness components of the image data of one frame, an F step for classifying the brightness components of the image data of one frame by gradients, and calculating frequencies of the gradients to generate a histogram thereof, and a G step for analyzing the histogram to determine an average gradient of all gradients in one frame, a number of peak regions including gradients which exceed a preset frequency, an average peak gradient of each of the peak gradients formed at each of the peak regions, and a degree of distribution representing a width of each of the peak regions.

The method for driving a display device further includes an H step for providing a light to the display panel, and an I step for generating a brightness control signal for controlling brightness of the light, wherein a duty ratio of the brightness control signal is adjusted with reference to the average gradient, the number of peak regions, the average peak gradients, and the degree of distribution.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included in provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
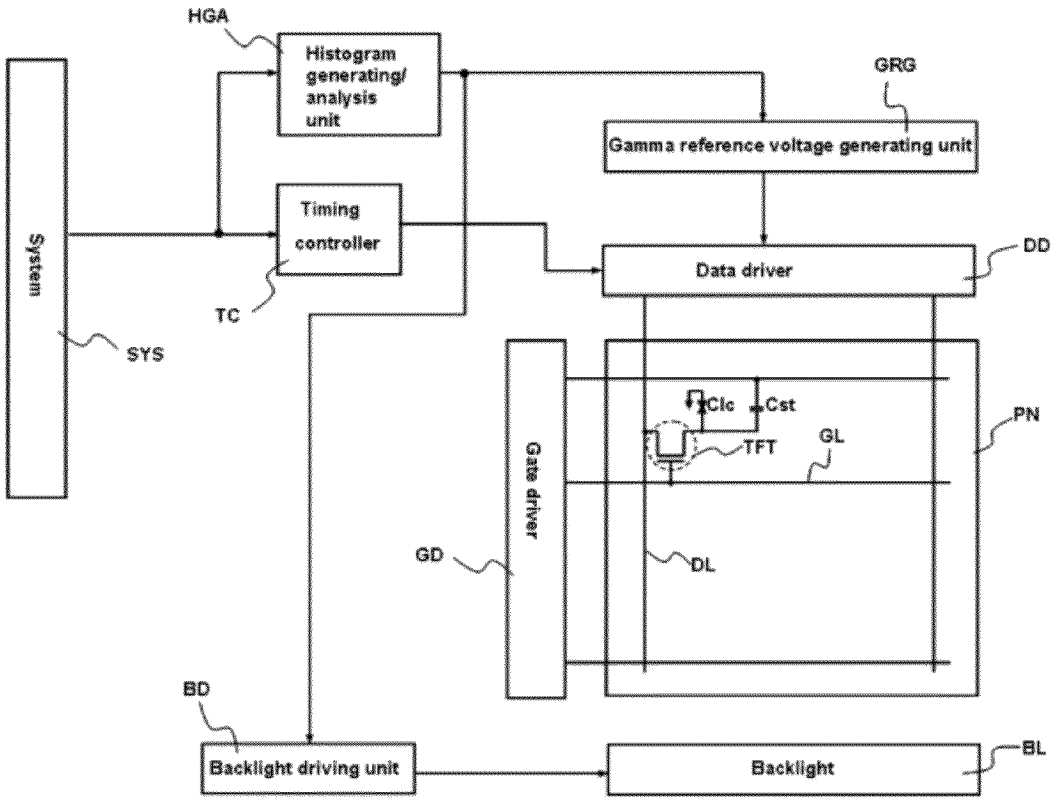
FIG. 1 illustrates a block diagram of a display device in accordance with a preferred embodiment of the present invention.

FIG. 1 illustrates a block diagram of a display device in accordance with a preferred embodiment of the present invention.

Referring to FIG. 1, the display device includes a system SYS, a display panel PN, a gate driver GD, a data driver DD, a timing controller TC, a histogram generation/analysis unit HGA, a gamma reference voltage generating unit GRG, a backlight driving unit BD and a backlight BL.

The display panel PN includes a matrix of pixels at crossed portions of a plurality of gate lines GL and a plurality of data lines DL. Each of the pixels includes a thin film transistor, a liquid crystal cell Clc, and a storage capacitor Cst. The thin film transistor TFT formed at each of the pixels supplies an analog image signal to the liquid crystal cell Clc from the data line DL in response to a scan signal from the gate line GL. The storage capacitor Cst is formed between a pixel electrode and a common electrode for sustaining a voltage stored at the liquid cell.

The histogram generation/analysis unit HGA analyzes the image data from the system frame by frame, generates a histogram of the image data included in each frame, and analyzes the histogram.

The gamma reference voltage generating unit GRG generates a plurality of gamma reference voltages and supplies the gamma reference voltages to the data driver DD. The gamma reference voltage generating unit GRG adjusts magnitude of the gamma reference voltages according to a result of the analysis from the histogram generation/analysis unit HGA and forwards the voltage adjusted thus.

The data driver DD is supplied with the plurality of gamma reference voltages from the gamma reference voltage generating unit GRG, and the data driver DD divides the plurality of gamma reference voltages by using resistance strings built therein to generate a plurality of gamma gradient voltages. And, the data driver DD converts the image data from the timing controller TC into analog image signals by using the gamma gradient voltages, and supplies the analog image signals to the data lines DL of the display panel PN.

The backlight BL provides a light to the display panel PN. Light sources in the backlight can be fluorescent lamps or light emitting diodes.

The backlight driving unit BD generates a brightness control signal for driving the backlight BL.

The histogram generation/analysis unit HGA will be described in more detail.

Figure 2:
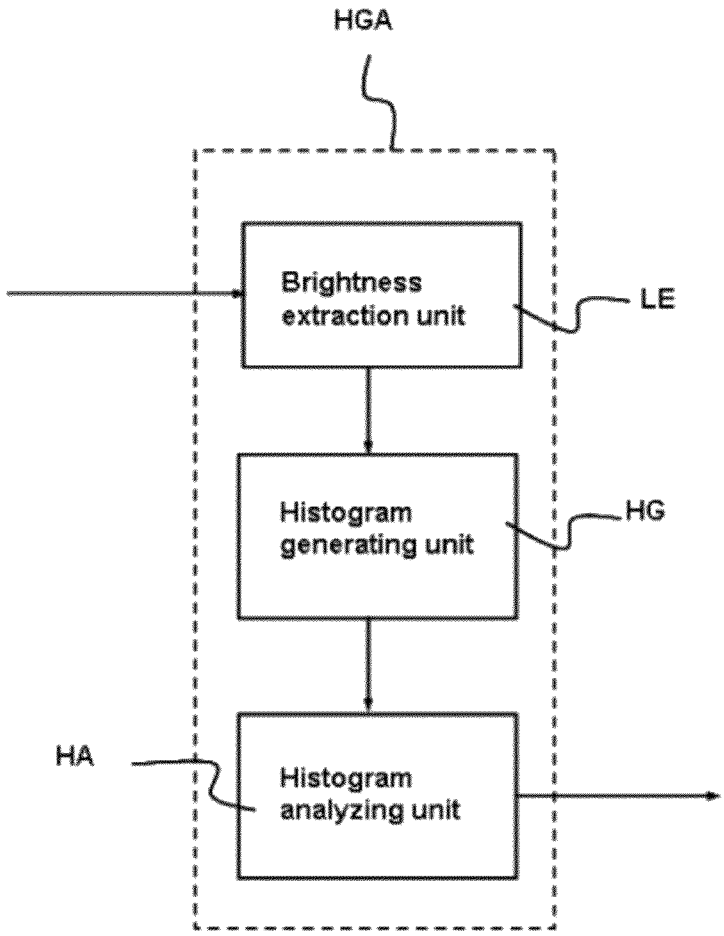
FIG. 2 illustrates a block diagram of the histogram generation/analysis unit in FIG. 1, in detail.

FIG. 2 illustrates a block diagram of the histogram generation/analysis unit HGA in FIG. 1, in detail.

Referring to FIG. 2, the histogram generation/analysis unit HGA includes a brightness extraction unit LE, a histogram generating unit HG, and a histogram analyzing unit HA.

The brightness extraction unit LE extracts brightness components of the image data of one frame.

The histogram generating unit HG classifies the brightness components of the image data of one frame from the brightness extraction unit LE by gradients, calculates frequencies of the gradients and generates a histogram thereof.

The histogram analyzing unit HA analyzes the histogram from the histogram generating unit HG to determine an average gradient of all gradients in one frame, a number of peak regions including the gradients which exceed a preset frequency, an average peak gradient of each of the peak gradients formed at each of the peak regions, and a degree of distribution representing a width of each of the peak regions.

The gamma reference voltage generating unit GRG selects the gamma reference voltage corresponding to the average peak gradient of each peak region, and adjusts magnitude of each of the gamma reference voltages adjacent to the gamma reference voltage selected thus according to the average peak gradient and the degree of distribution. In this instance, the gamma reference voltage generating unit GRG adjusts the magnitude of each of the gamma reference voltages such that voltage differences among the gamma reference voltages of the peak region become the smaller, as the degrees of distribution become the greater While the gamma reference voltage generating unit GRG adjusts the magnitude of each of the gamma reference voltages such that voltage differences among the gamma reference voltages of the peak region become the greater, as the degrees of distribution become the smaller.

The gamma reference voltage generating unit GRG adjusts the magnitude of the gamma reference voltages except the gamma reference voltage having the greatest magnitude and the gamma reference voltage having the smallest magnitude. That is, the gamma reference voltage generating unit GRG maintains the gamma reference voltage having the greatest magnitude and the gamma reference voltage having the smallest magnitude as they are.

The gamma reference voltage generating unit GRG may have a plurality of look-up tables having the plurality of the gamma reference voltages stored therein in advance according to forms of the histograms. In this case, the gamma reference voltage generating unit GRG selects and forwards the gamma reference voltages stored in one of the look-up tables according to histogram information supplied thereto.

And, the gamma reference voltage generating unit GRG may be supplied with different pieces of digitized information from the histogram analyzing unit HA and adjust the magnitude of the gamma reference voltages according to the digitized information.

Figure 3:
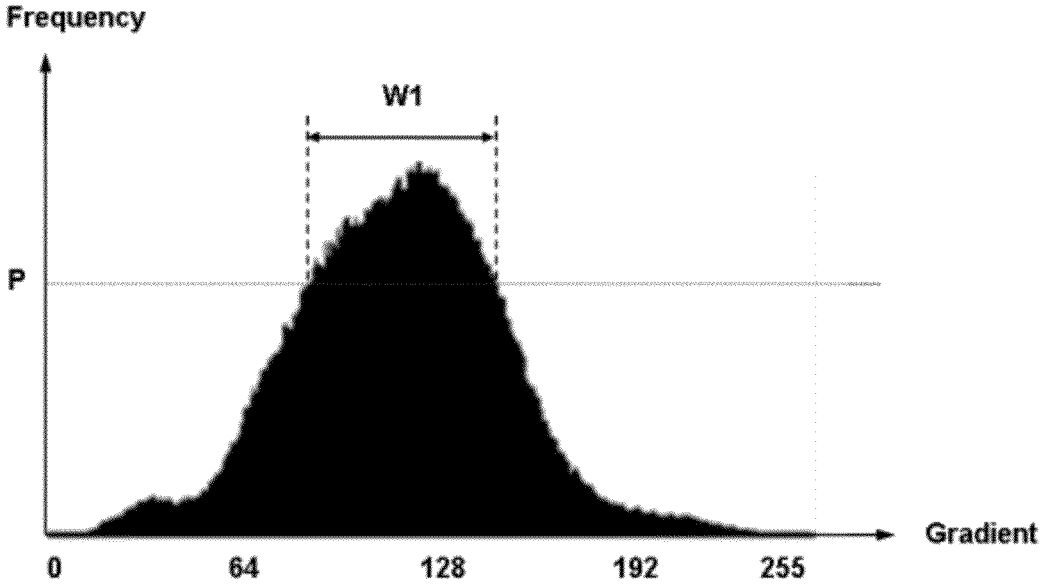
FIG. 3 illustrates a histogram of image data on a particular frame.

FIG. 3 illustrates a histogram of image data on a particular frame.

The histogram generated at the histogram generating unit HG can have a form as shown in FIG. 3. The histogram has an X-axis denoting a level of the gradient, for an example, may be set from 0 gradient to 255 gradient, and a Y-axis denoting a frequency of the gradient. From the histogram, it can be known that an average gradient of all gradients in one frame, a number of peak regions including gradients which exceed the preset frequency, an average peak gradient of each of the peak gradients formed at each of the peak regions, and a degree of distribution denoting a width of each of the peak regions. P denotes a threshold frequency, wherein a position where the gradient of which frequency exceeds the threshold frequency is the peak region. That is, in FIG. 3, the peak region including the gradient of which frequency exceeds the threshold frequency is one place. The average peak gradient at the peak region is an average of the gradients positioned within a distribution width W1.

Figure 4:
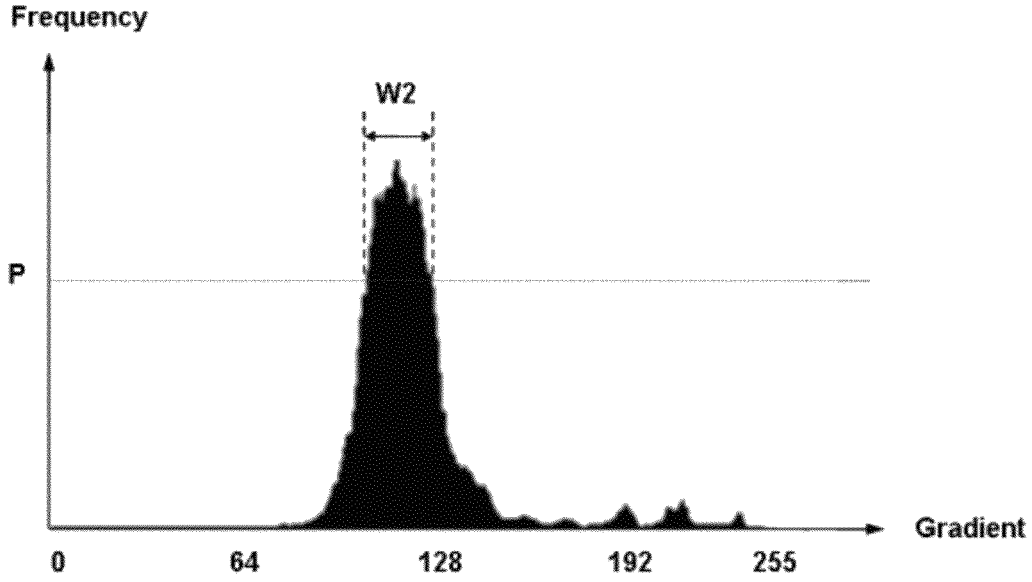
FIG. 4 illustrates another histogram of image data on a particular frame.

FIG. 4 illustrates another histogram of image data on a particular frame, showing a smaller distribution width W2 than the histogram illustrated in FIG. 3.

Figure 5:
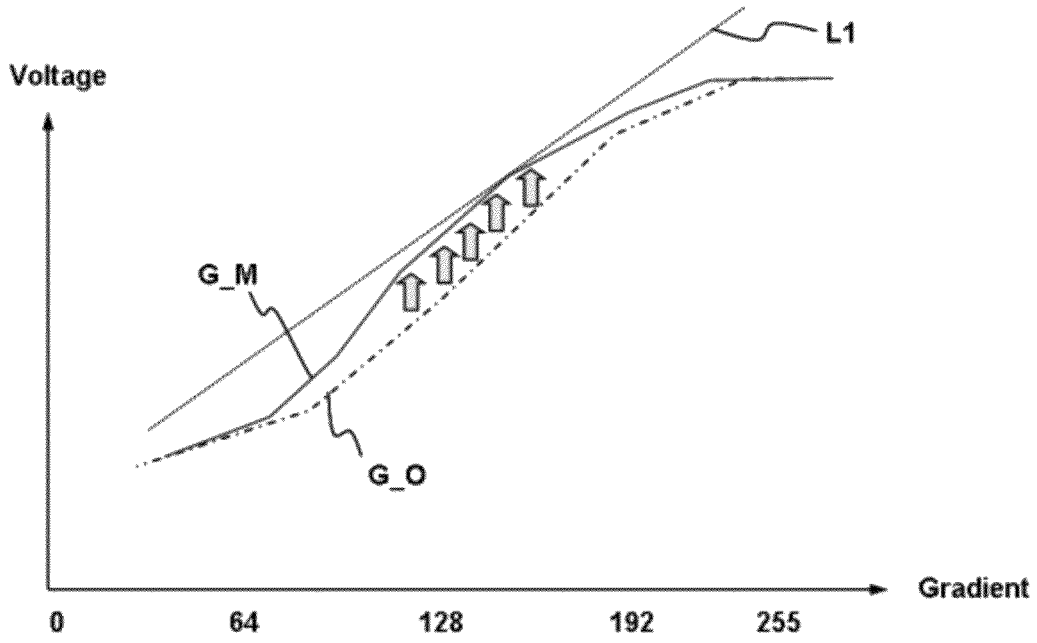
FIG. 5 illustrates a gamma gradient curve generated based on the histogram in FIG. 3.

FIG. 5 illustrates a gamma gradient curve generated based on the histogram in FIG. 3. The gamma reference voltage generating unit GRG is supplied with the histogram in FIG. 3, and the gamma reference voltage generating unit GRG adjusts magnitude of the gamma reference voltages to make the data driver DD generate a second gamma gradient curve G_M instead of the first gamma gradient curve G_O. For an example, if it is assumed that the average gradient in FIG. 3 is a 100 gradient, in order to emphasize the 100 gradient of the original first gamma gradient curve G_O and gradients adjacent to the 100 gradient (97~99 gradients, and 101~103 gradients) more, the gamma reference voltage generating unit GRG modulates the gamma reference voltage of the 100 gradient and the gamma reference voltages adjacent thereto to generate the second gamma gradient curve G_M. For an example, if the gamma reference voltage generating unit GRG generates eight gamma reference voltages different from one another, the gamma reference voltage generating unit GRG selects one of the gamma reference voltages falling on the 100 gradient, and gives weighted values to the gamma reference voltage of the 100 gradient and the gamma reference voltages adjacent to the gamma reference voltage of the 100 gradient, to modulate the gradients.

If there is no gamma reference voltage of the 100 gradient, the gamma reference voltage generating unit GRG selects a gamma reference voltage having a gradient the most close to the 100 gradient and modulates the gamma reference voltage selected thus and the gamma reference voltages adjacent to the gamma reference voltage selected thus. For an example, if the gamma reference voltage generating unit GRG generates eight gamma reference voltages different from one another, the gamma reference voltage generating unit GRG selects one of the eight gamma reference voltages which is the most close to the gamma reference voltage of the 100 gradient, and gives weighted values to the gamma reference voltage selected thus and the gamma reference voltages adjacent the gamma reference voltage selected thus, to modulate the gradients.

Figure 6:
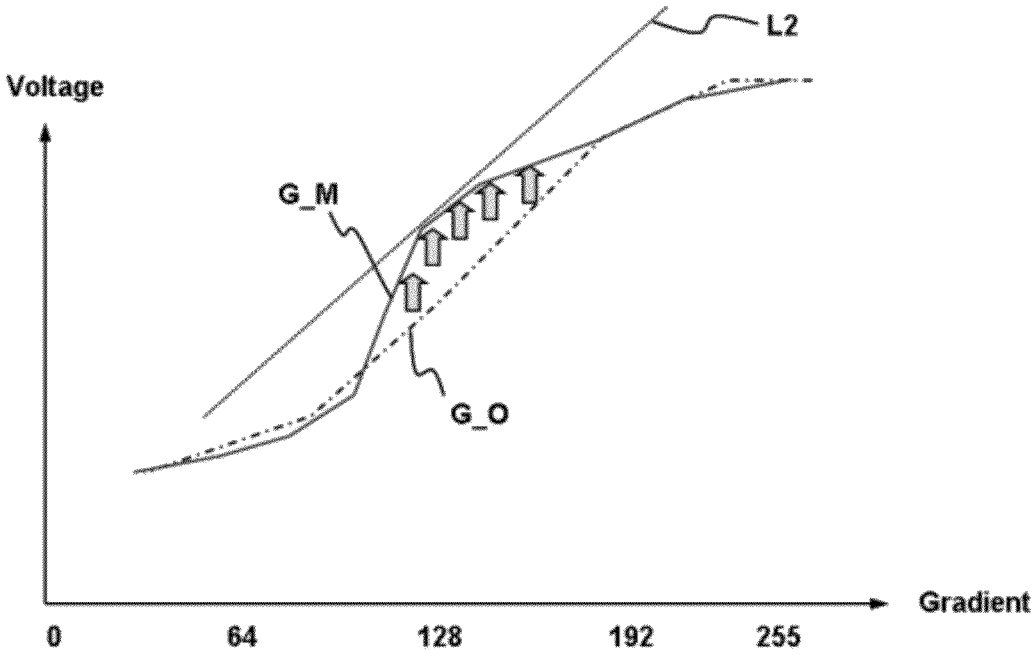
FIG. 6 illustrates a gamma gradient curve generated based on the histogram in FIG. 4.

FIG. 6 illustrates a gamma gradient curve generated based on the histogram in FIG. 4, wherein it can be known that the second gamma gradient curve G_M in FIG. 6 has a slope L2 steeper than a slope L1 of the second gamma gradient curve G_M in FIG. 5. This is because the histogram in FIG. 4 has a distribution width W2 smaller than the distribution width W1 of the histogram in FIG. 3.

Figure 7:
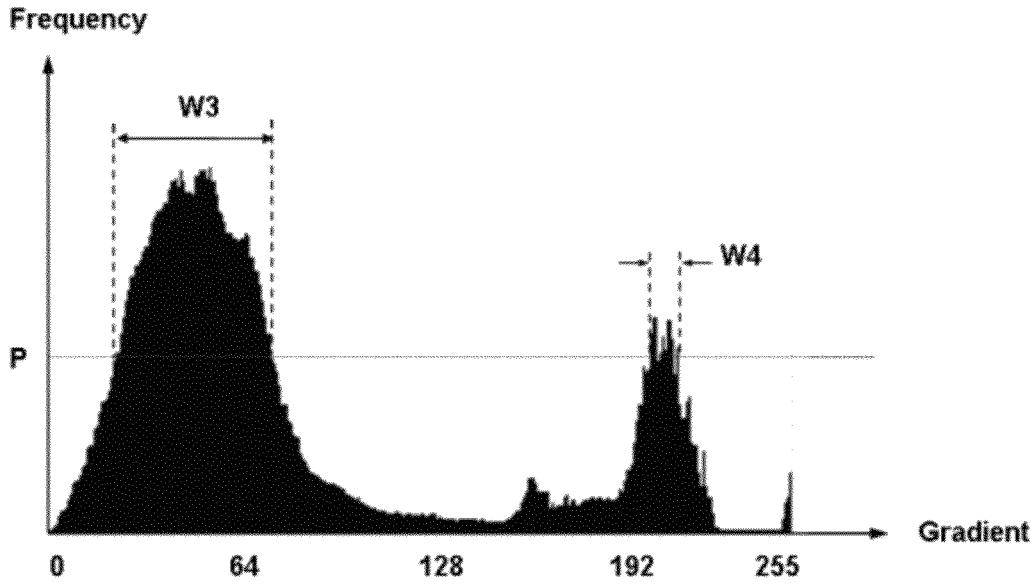
FIG. 7 illustrates another histogram of image data on a particular frame.

FIG. 7 illustrates another histogram of image data on a particular frame, wherein it can be noted that there are two peak regions. That is, there are two peak regions both of which exceed the threshold frequency P and have a great gradient difference from each other.

Figure 8:
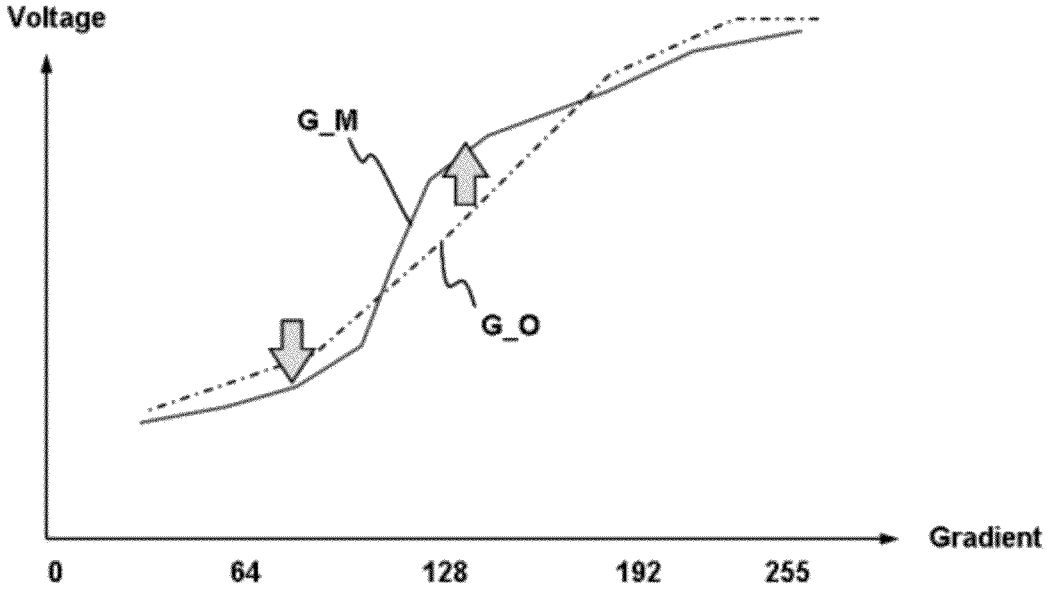
FIG. 8 illustrates a gamma gradient curve generated based on the histogram in FIG. 7.

FIG. 8 illustrates a gamma gradient curve generated based on the histogram in FIG. 7. By adjusting magnitude of the gamma reference voltages of the peak region having a distribution width of W3 to be smaller than original magnitude and adjusting magnitude of the gamma reference voltages of the peak region having a distribution width of W4 to be greater than original magnitude, a contrast and sharpness of the image can be improved.

Thus, by modulating the gamma reference voltages of every frame with reference to the histogram of image data of one frame, a picture quality can be improved.

And, the backlight driving unit BD adjusts a duty ratio of a brightness control signal with reference to the average gradient, a number of the peak regions, the average peak gradient and the degree of distribution from the histogram analyzing unit HA.

For an example, referring to FIGS. 3 and 4, if the histogram has one peak region, the backlight driving unit BD calculates the duty ratio by the following equation 1.

$$\text{Duty Ratio}=(\text{Greatest Duty}-\text{Smallest Duty})*(\text{Average peak gradient}/\text{Maximum gradient})+\text{Smallest duty} \quad (1)$$

For an example, if it is assumed that the backlight BL has a duty range of smallest 30%~greatest 100%, in FIG. 3, the greatest gradient is 255, and the average peak gradient is 100, a duty ratio of 57.5% can be calculated by above equation 1 (100−30)*(100/255)+30.

In the meantime, referring to FIG. 7, if the histogram has two or more than two peak regions, the backlight driving unit BD calculates the duty ratio by the following equation 2.

$$\text{Duty Ratio}=(\text{Greatest Duty}-\text{Smallest Duty})*(\text{Maximum average peak gradient}/\text{Maximum gradient})+\text{Smallest duty} \quad (2)$$

In the equation 2, the maximum average peak gradient denotes greatest one of a plurality of average peak gradients.

For an example, if it is assumed that the backlight BL has a duty range of smallest 30%~greatest 100%, in FIG. 7, the greatest gradient is 255, the average peak gradient of the peak region having the distribution width of W3 is 50, and the average peak gradient of the peak region having the distribution width of W4 is 200, a duty ratio of 85% can be calculated by above equation 2 (100−30)*(200/255)+30.

One frame of image corresponding to the histogram in FIG. 3 can be a plain image having many 100 gradient images distributed thereon substantially, and one frame of image corresponding to the histogram in FIG. 7 can be an image in which 50 gradient dark images and 200 gradient bright images are distributed thereon at the same time. For an example, the image of FIG. 7 can be an image in which significantly bright dots present partially on a dark background on the whole. Thus, though FIGS. 3 and 7 imply images different from each other completely, the average gradients thereof can be the same. However, it is required that the image of FIG. 7 is displayed as an image brighter than the image of FIG. 3. By selecting any one of the equations 1 and 2 according to a number of the peak regions, and controlling the brightness control signal and the duty ratio, a light of brightness proper to the image can be supplied.

In the meantime, the timing controller TC of the present invention can modulate the image data to expand the gradients of the image data.

As has been described, the display device and the method for driving the same of the present invention have the following advantages.

First, by analyzing a histogram of image data on one frame and adjusting magnitude of gamma reference voltages with reference to the result of analysis, a gamma gradient curve proper to the image can be generated.

Second, by controlling the duty ratio of the brightness control signal with reference to the result of analysis of the histogram, a contrast can be enhanced, and power consumption can be reduced.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A display device comprising:

a histogram generation/analysis unit for analyzing image data supplied thereto from an outside frame by frame, generating a histogram of the image data included in each of the frames, and analyzing the histograms;

a gamma reference voltage generating unit for generating a plurality of gamma reference voltages and adjusting magnitude of the gamma reference voltages according to a result of analysis from the histogram generation/analysis unit and forwarding the adjusted gamma reference voltages;

a timing controller for re-arranging the image data supplied thereto from an outside, controlling output timings of the re-arranged image data and forwarding the re-arranged image data; and a data driver for generating a plurality of gamma gradient voltages by using the plurality of gamma reference voltages from the gamma reference voltage generating unit, converting the re-arranged image data from the timing controller into analog image signals by using the gamma gradient voltages and supplying the analog image signals to a display panel, wherein the histogram generation/analysis unit includes:

a brightness extraction unit for extracting brightness components of the re-arranged image data of one frame, a histogram generating unit for classifying the brightness components of the re-arranged image data of one frame from the brightness extraction unit by gradients and calculating a frequency of each of the gradients to generate a histogram thereof, and a histogram analyzing unit for analyzing the histogram from the histogram generating unit to determine an average gradient of all gradients in one frame, a number of peak regions including gradients which exceed a preset frequency, an average peak gradient of each of the peak gradients formed at each of the peak regions, and a degree of distribution representing a width of each of the peak regions.

2. The display device as claimed in claim 1, wherein the gamma reference voltage generating unit selects a gamma reference voltage of the average peak gradient of each of the peak regions with reference to the average peak gradient and the degree of distribution from the histogram analyzing unit and adjusts magnitude of the gamma reference voltages adjacent to the gamma reference voltage selected according to the degree of distribution.

3. The display device as claimed in claim 2, wherein the gamma reference voltage generating unit adjusts magnitude of the gamma reference voltages such that voltage differences among the gamma reference voltages of the peak regions become the smaller, as the degrees of distribution become the greater;

wherein the gamma reference voltage generating unit adjusts the magnitude of each of the gamma reference voltages such that voltage differences among the gamma reference voltages of the peak region become the greater, as the degrees of distribution become the smaller.

4. The display device as claimed in claim 1, wherein the gamma reference voltages include a greatest gamma reference voltage having a greatest magnitude and a smallest gamma reference voltage having a smallest magnitude, wherein the gamma reference voltage generating unit adjusts the magnitude of all gamma reference voltages excluding the greatest gamma reference voltage and the smallest gamma reference voltage.

5. The display device as claimed in claim 1, further comprising:

a backlight for providing a light to the display panel; and a backlight driving unit for generating a brightness control signal for driving the backlight, wherein the backlight driving unit adjusts a duty ratio of the brightness control signal with reference to the average gradient, the number of peak regions, the average peak gradients, and the degree of distribution.

6. The display device as claimed in claim 5, wherein the backlight driving unit adjusts the duty ratio of the brightness control signal with reference to a greatest average peak gradient.

7. A method for driving a display device comprising:

an A step for analyzing image data supplied from an outside frame by frame, generating a histogram of the image data included in each of the frames, and analyzing the histograms;

a B step for generating a plurality of gamma reference voltages and adjusting magnitude of the gamma reference voltages according to a result in the A step;

a C step for re-arranging the image data supplied thereto from an outside, controlling output timings of the re-arranged image data and forwarding the re-arranged image data; and a D step for generating a plurality of gamma gradient voltages by using the plurality of gamma reference voltages, converting the re-arranged image data from the C step into analog image signals by using the gamma gradient voltages and supplying the analog image signals to a display panel, wherein the A step includes:

an E step for extracting brightness components of the re-arranged image data of one frame, an F step for classifying the brightness components of the re-arranged image data of one frame by gradients, and calculating frequencies of the gradients to generate a histogram thereof, and a G step for analyzing the histogram to determine an average gradient of all gradients in one frame, a number of peak regions including gradients which exceed a preset frequency, an average peak gradient of each of the peak gradients formed at each of the peak regions, and a degree of distribution representing a width of each of the peak regions.

8. The method for driving a display device as claimed in claim 7, further comprising:

an H step for providing a light to the display panel; and an I step for generating a brightness control signal for controlling brightness of the light, wherein a duty ratio of the brightness control signal is adjusted with reference to the average gradient, the number of peak regions, the average peak gradients, and the degree of distribution.

9. The display device as claimed in claim 1, further comprising:

a backlight for providing a light to the display panel; and a backlight driving unit for generating a brightness control signal for driving the backlight, wherein if the histogram has one peak region, the backlight driving unit adjusts a duty ratio of the brightness control signal by the following equation 1 of "Duty Ratio=(Greatest Duty−Smallest Duty)*(Average peak gradient/Maximum gradient)+Smallest duty", and wherein if the histogram has two or more peak regions, the backlight driving unit adjusts a duty ratio of the brightness control signal by the following equation 2 of "Duty Ratio=(Greatest Duty−Smallest Duty)*(Average peak gradient/Maximum gradient)−Smallest duty".

* * * * *